US005526595A

United States Patent [19]

Daulasim et al.

[11] Patent Number: 5,526,595

[45] Date of Patent: Jun. 18, 1996

[54] STEAM IRON HAVING A CARTRIDGE FOR TREATING WATER OR CLOTH TO BE IRONED

[75] Inventors: Denis Daulasim, Villeurbanne; Jean-Louis Brandolini, Saint-Etienne; Jean-Pierre DeBourg, Lyons, all of France

[73] Assignee: SEB S.A., Selongey, France

[21] Appl. No.: 9,619

[22] Filed: Jan. 27, 1993

[30] Foreign Application Priority Data

Jan. 27, 1992 [FR] France ..... 92 00825
Apr. 29, 1992 [FR] France ..... 92 05277

[51] Int. Cl.[6] ..... D06F 75/22; C02F 1/00

[52] U.S. Cl. ..... 38/77.8; 210/94

[58] Field of Search ..... 38/77.3, 75, 77.5, 38/77.8, 77.81; 210/94, 282

[56] References Cited

U.S. PATENT DOCUMENTS

| | | | |
|---|---|---|---|
| 1,537,916 | 5/1925 | Black | 38/77.3 |
| 2,634,526 | 4/1953 | McGraw | 38/77.3 |
| 3,101,562 | 8/1963 | Crawford | 38/77.3 |
| 3,468,043 | 9/1969 | Turner | 38/77.1 |
| 3,534,488 | 10/1970 | Hardwick et al. | 38/77.3 |
| 3,590,504 | 7/1971 | Davidson | 38/77.1 |
| 4,260,873 | 4/1981 | Simmonds | 38/77.8 X |
| 4,657,672 | 4/1987 | Allen | 210/94 |
| 4,770,768 | 9/1988 | Lang | 210/94 |
| 4,927,533 | 5/1990 | Takase et al. | 210/282 X |
| 5,138,778 | 8/1992 | Brandolini | 38/77.5 X |

FOREIGN PATENT DOCUMENTS

| | | | |
|---|---|---|---|
| 0089256 | 9/1983 | European Pat. Off. . | |
| 0306623 | 3/1989 | European Pat. Off. | 38/77.5 |
| 0402255 | 12/1990 | European Pat. Off. . | |
| 2632331 | 12/1989 | France . | |
| 2648485 | 12/1990 | France . | |
| 2653455 | 4/1991 | France . | |
| 3083964 | 4/1982 | Germany | 38/77.8 |
| WO91/19037 | 12/1991 | WIPO . | |

OTHER PUBLICATIONS

Menachem Lewin et al., Fundamentals and Preparation Part A–Handbook of Fiber Science and Technology: vol. 1, Chemical Processing of Fibers and Fabrics, 1983.
Menachem Lewin et al., Fundamentals and Preparation Part B–Handbook of Fiber Science and Technology: vol. 1, Chemical Processing of Fibers and Fabrics, 1984.
Menachem Lewin et al., Functional Finishes Part A–Handbook of Fiber Science and Technology: vol. II, Chemical Processing of Fibers and Fabrics, 1983.
Menachem Lewin et al., Functional Finishes Part B–Handbook of Fiber Science and Technology: vol. II, Chemical Processing of Fibers and Fabrics 1984.
Bayer, Erkantol AS Mar. 1981.
Bayer Erkantol CW Jul. 1990.
Bayer, Persoftal OE Aug. 1989.
Sanitized, Sanitized GT 86–06 Apr. 1993.
Rhône Poulenc, Repel–O–Tex Soil Release Polymer for Laundry Applications, Technical Bulletin 1993.
Ciba–Geigy, Knittex FLC May 1987.

*Primary Examiner*—Ismael Izaguirre
*Attorney, Agent, or Firm*—Kenyon & Kenyon

[57] ABSTRACT

A steam iron has a reservoir from which water is supplied to a vaporization chamber. A plurality of cartridges are placed within a housing of the iron and at least one cartridge contains a product other than a demineralizing product for the purpose of treating water or cloth to be ironed. A ramp is provided for bringing the water of the reservoir into contact with the treatment product. A duct beneath the cartridge conveys the water charged with the treatment product to a vaporization chamber. A plurality of steam discharge orifices in communication with the vaporization chamber distributes the treated water on the cloth to be ironed. The plurality of cartridges are arranged such that at least one is arranged in parallel or in series, or a combination of these, along a path in which water flows as it travels from the reservoir to the vaporization chamber.

23 Claims, 13 Drawing Sheets

STEAM IRON HAVING A CARTRIDGE FOR TREATING WATER OR CLOTH TO BE IRONED

BACKGROUND OF THE INVENTION

1. Field of the Invention

The present invention relates to a steam iron equipped with at least one cartridge for treating water or cloth to be ironed.

2. Description of the Prior Art

In a known steam iron as disclosed in particular in French patent No. 2,648,163 in the name of the present Applicant, the water circuit located between the water reservoir and the vaporization chamber of the iron includes a cartridge which contains a demineralizing product such as an ion exchange resin.

Said cartridge serves to prevent any deposition of scale within the water circuit of the iron and in particular within its vaporization chamber and within the steam discharge orifices formed in the sole-plate of the iron.

It is also known to make use of various products for treating the textile articles before or after ironing. These products can be waterproofing products, hydrophilic products, bactericides, starching products, products for removing creases, products for forming pleats, products for facilitating vaporization, and so on.

These products are provided in containers and are spread over the textile articles before or after ironing.

The object of the present invention is to enable users to avoid tedious handling of these containers while providing an iron which is capable of automatically spreading one or a number of the above-mentioned treatment products over the textile articles during operation of the iron.

SUMMARY OF THE INVENTION

In accordance with the invention, the steam iron having a reservoir for supplying water to a vaporization chamber is distinguished by the fact that said iron has at least one cartridge containing a product other than a demineralizing product for the purpose of treating water or cloth to be ironed, means being provided for bringing the water of the reservoir into contact with the treatment product and for distributing the resulting water over the cloth to be ironed.

While ironing is in progress, the user can thus treat the water and/or the articles to be ironed without having to handle containers or devices which are separate from the iron.

In an advantageous embodiment of the invention, the cartridge contains a product capable of being diluted or of diffusing in water which is brought into contact therewith.

In consequence, when the iron is in use, the water contained in the reservoir is progressively charged by dilution or diffusion of the product contained in the cartridge.

Preferably, the cartridge contains at least one treatment product having at least one of the following functions:

waterproofing of the cloth;

making the cloth hydrophilic;

making the cloth hydrophobic;

disinfecting or asepticizing;

producing firmness of pleats;

improving the removal of creases;

supplying an optical adjuvant;

starching;

deodorizing;

improving the wetting power of the water;

facilitating vaporization, etc.

In a preferred embodiment of the invention, the iron is equipped with a plurality of cartridges containing treatment products.

The iron can be equipped with a single cartridge having a plurality of compartments containing treatment products.

Moreover, one of the cartridges or one of the compartments can contain a demineralizing product.

The cartridge or cartridges can be removably placed within one or a number of housings which are formed in the iron and each communicate either with the water introduced into the reservoir or with the water discharged from the reservoir or with the water contained in the reservoir.

In one embodiment, the cartridges or the compartments of the cartridge are arranged in series with respect to the path of the water which comes from the reservoir.

In another embodiment, the cartridges or the compartments of the cartridge are arranged in parallel with respect to the path of the water which comes from the reservoir.

In another embodiment, the cartridges or the compartments of said cartridges are arranged in a circuit which combines the series and parallel modes.

Means can be provided for controlling the rate of flow of water within each cartridge or each compartment.

In another embodiment, the iron is provided with means which can be actuated by the user for initiating the introduction into the reservoir or the water circuit of the iron of a predetermined dose of product contained in the cartridge.

The product or the products can be associated with a carrier for controlling the solubility of the product in water.

In an exemplified embodiment, the water which has been contacted with at least one of the products is discharged outwards from the iron in spray form through the steam discharge orifices.

In another exemplified embodiment, the water which has been contacted with at least one of the products is discharged outwards from the iron through an outlet which is directed towards the articles to be ironed, said outlet being separate and distinct from the steam discharge orifices.

In this case, one of the products can be discharged to the exterior by a spray discharge system actuated by a hand pump or electric pump.

The cartridge containing the treatment product can be refillable or disposable after a certain number of operations of the iron or after a predetermined period of use.

The user can thus decide whether it is necessary to replace the cartridge with a fresh cartridge.

Other features and advantages of the invention will also become apparent from the description which now follows.

Figure 1:
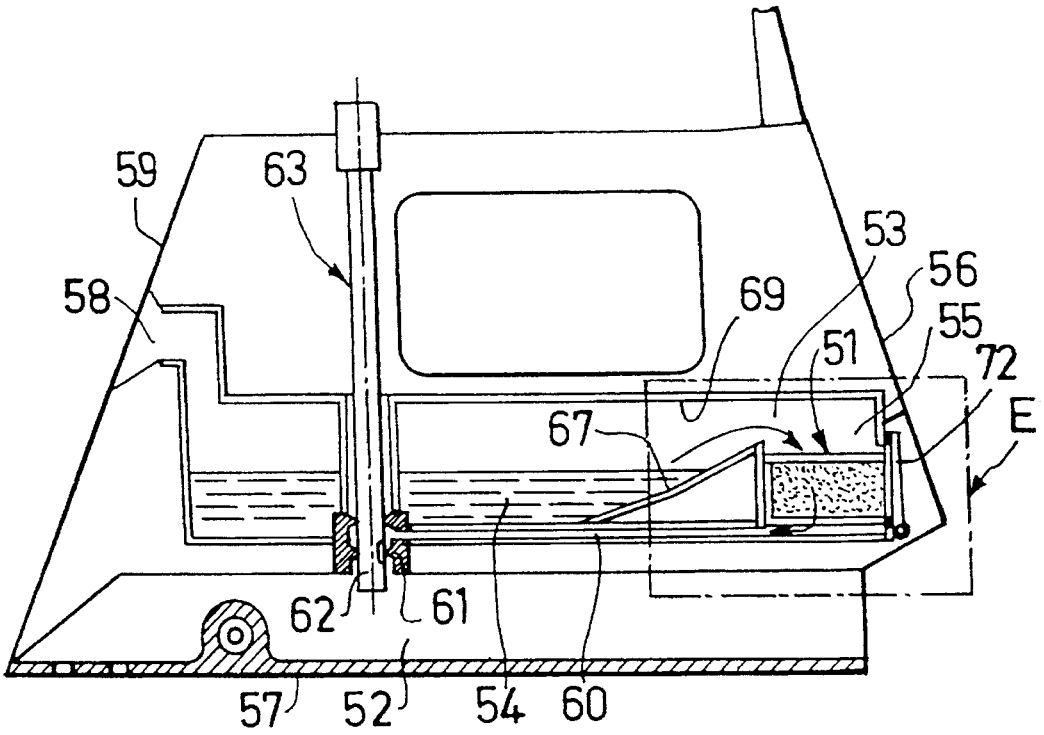
FIG. 1 is a schematic longitudinal sectional view of an iron in accordance with the invention and provided with a treatment cartridge.
Figure 2:
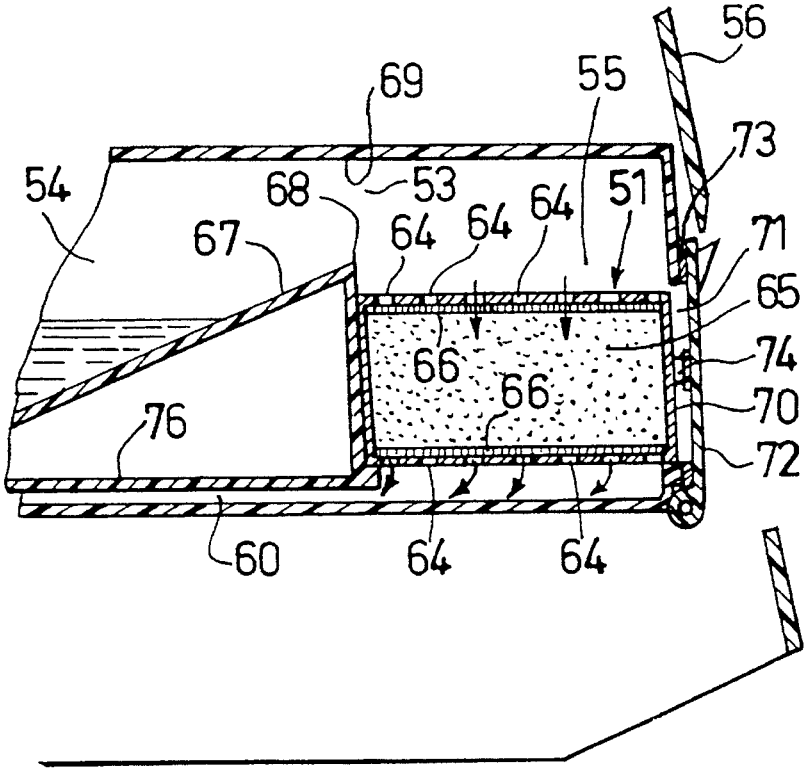
FIG. 2 is a view to a larger scale showing the detail E of FIG. 1.
Figure 3:
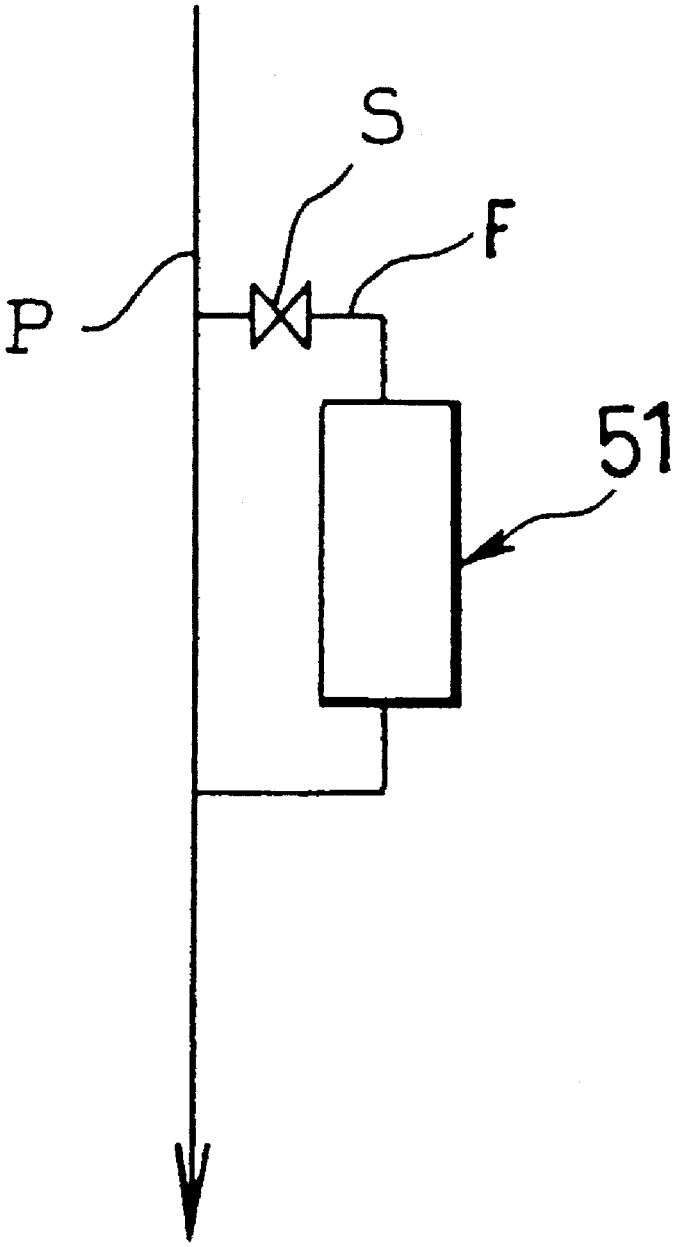
FIG. 3 is a diagram relating to an alternative embodiment.

DESCRIPTION OF THE DEVICE ILLUSTRATED IN FIGS. 1 to 3

In the embodiment shown in these figures, the iron has a removable cartridge 51 containing a product for treating textile articles to be ironed.

In this form of construction, the cartridge 51 is placed between the outlet 53 of the water reservoir 54 of the iron and the vaporization chamber 52.

Moreover, in this example, the cartridge 51 is located at the rear end and removably fitted in a housing 55 which opens on the rear face 56 of the iron.

The water reservoir 54 extends horizontally above the vaporization chamber 52 and the sole-plate 57 of the iron. The water reservoir 54 has a water inlet 58 which has its opening on the front face 59 of the iron.

It is apparent that the cartridge 51 is located at the rear end of the water reservoir and is supplied with water which flows from the reservoir 54 onto the top face of the cartridge 51. A duct 60 has its opening beneath the cartridge 51 and conveys the water charged with treatment product towards the vaporization chamber 52 via the chamber 61 through which extends the pin 62 of the conventional flow-regulating system 63 which is conventionally designated as a "drip-feed" system.

The walls of the cartridge 51 through which the water flows into and out of said cartridge are provided with openings 64. Between said openings 14 and the treatment product 65 contained in the cartridge 1 is placed a layer 66 which is permeable to the water.

Moreover, upstream of the wall through which the water enters the cartridge 51, the water reservoir 54 has an inclined plane or ramp 67 which extends across the entire width of the reservoir and the top edge 68 of which is adjacent to the cartridge 51 and is located slightly above the wall through which water is admitted into the cartridge. Said top edge 68 defines with the top wall 69 of the water reservoir 54 a passage 53 through which the water can pass from the reservoir 54 into the housing 55 containing the cartridge 51, as will be explained in greater detail below.

In addition, the wall 70 of the cartridge 51 which is adjacent to the opening 74 of the housing 55 of said cartridge is transparent and accordingly serves to observe the state of the product or the level of product contained in the cartridge 51.

Moreover, the opening 71 of the housing 55 of the cartridge 51 is closed by a hinged shutter 72 which is applied against a seal 73 and against a projection 74 formed on the wall 70 of the cartridge 51 which serves to facilitate the withdrawal of this cartridge from the housing 55.

In the example shown in the drawings, the cartridge 51 has a parallelepipedal shape. In particular, the water inlet and outlet walls of the cartridge 51 are parallel to the horizontal walls 69 and 76 of the water reservoir 54. The water outlet wall of the cartridge 51 is located slightly above the bottom wall 76 of the reservoir 54.

The operation of the device described in the foregoing will now be explained.

Before the iron is put into service for the first time, the user places a new cartridge 1 within the housing 5.

It is then only necessary for the user to fill the reservoir 54 with tap water which is introduced directly through the opening 58.

While ironing is being performed, the motion of the iron causes the water to flow up the inclined plane 67 which connects the bottom wall 76 of the reservoir to the housing 55, then to flow over the edge 68 and to penetrate into the cartridge 51 in which the water is treated.

The treated water flows into the duct 60 which extends beneath the reservoir 54 and which opens into the chamber 61 of the flow-regulating pin. The water then flows drop by drop into the vaporization chamber 52.

Each time the iron is placed in the vertical position of rest by means of its rear bearing face 56 also known as the heel, the cartridge 51 is automatically filled with water.

After a predetermined period of operation of the iron, the cartridge 51 is emptied of its contents. The user may observe the level of product by opening the shutter 72, through the transparent wall 70 of the cartridge. The cartridge may then be removed and replaced by a fresh cartridge.

The design described in the foregoing is suitable for a product which dissolves or mixes only slowly with the water from the reservoir.

When the treatment product employed is a product which mixes or dissolves rapidly in water, the cartridge 1 must be located in a bypass F off the main water circuit P as indicated in FIG. 3. In this case, the duct of the bypass circuit F must have a small cross-sectional area so that the rate of flow of water within the duct should be low in comparison with the rate of flow of water within the main circuit.

Preferably, a valve S is provided in the bypass circuit F upstream of the cartridge 1 in order to isolate the contents of this latter from the water which circulates within the main circuit. Opening of said valve S is controlled by the user, for example by means of a control knob located on the iron, when the user desires that the treatment product contained in the cartridge should be mixed with the water which is brought into the vaporization chamber and is discharged from the sole-plate at the same time as the steam.

Figure 4:
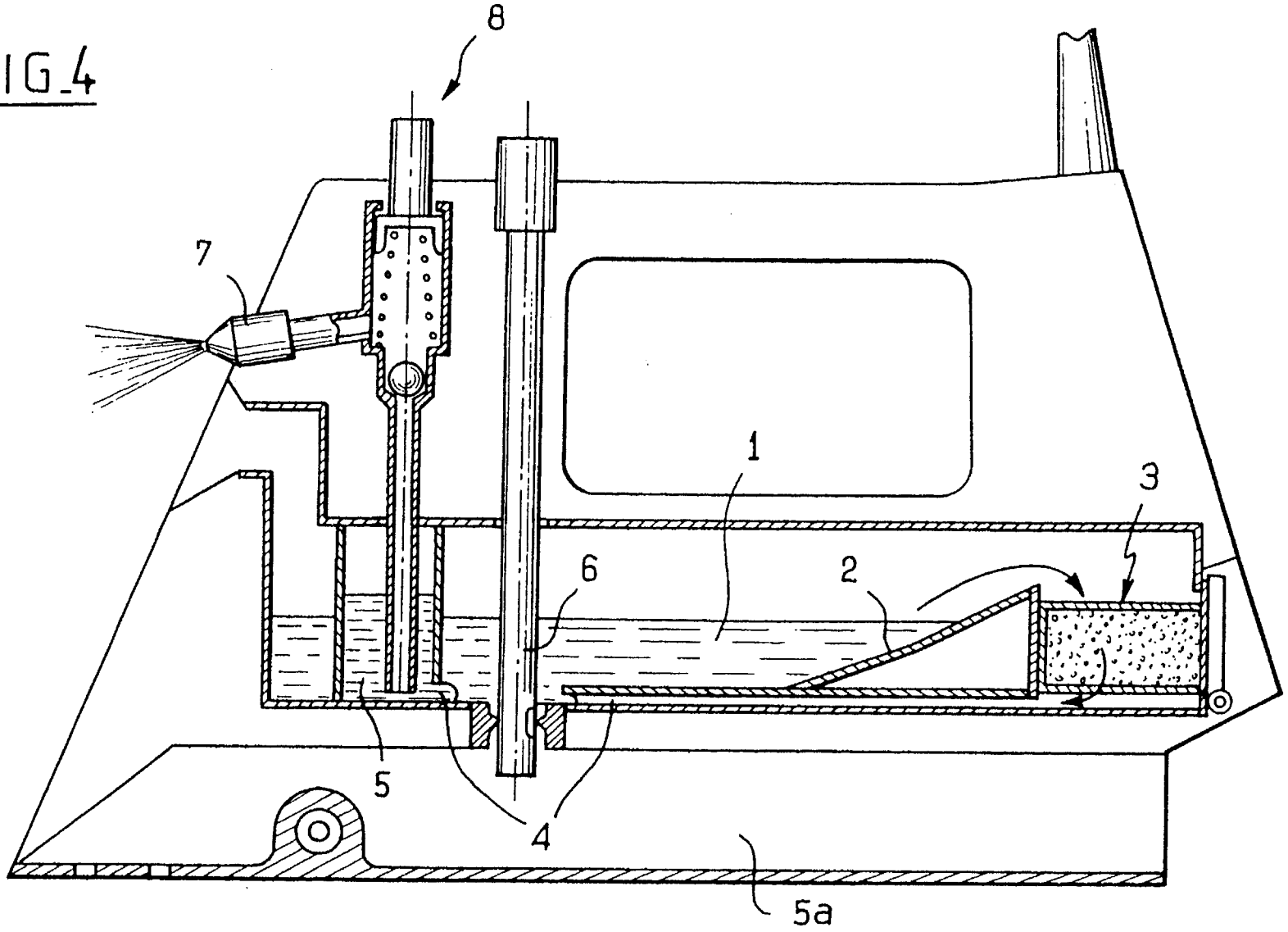
FIGS. 4 to 6 are schematic longitudinal sectional views of irons in accordance with another embodiment of the invention.
Figure 5:
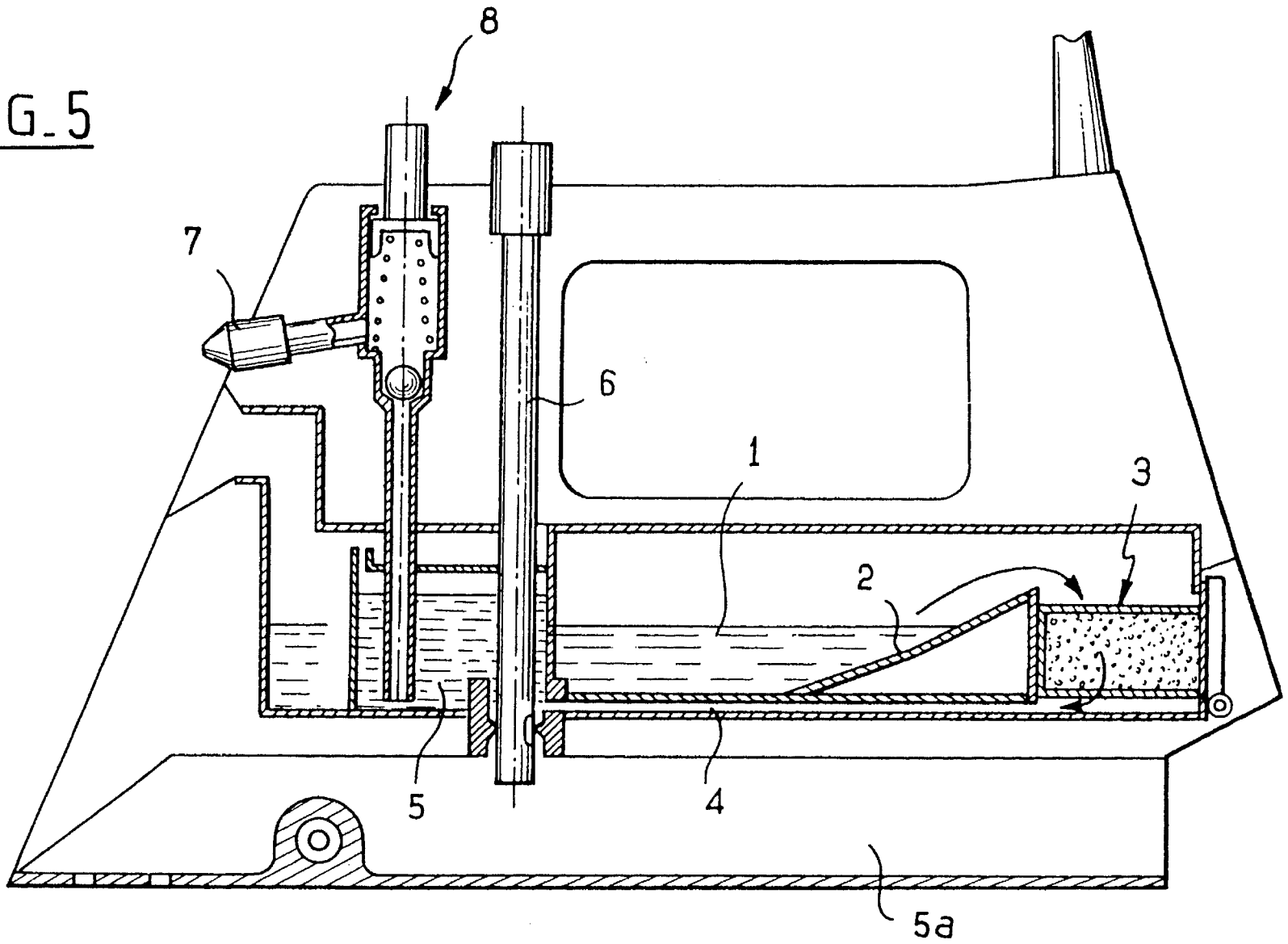
Figure 6:
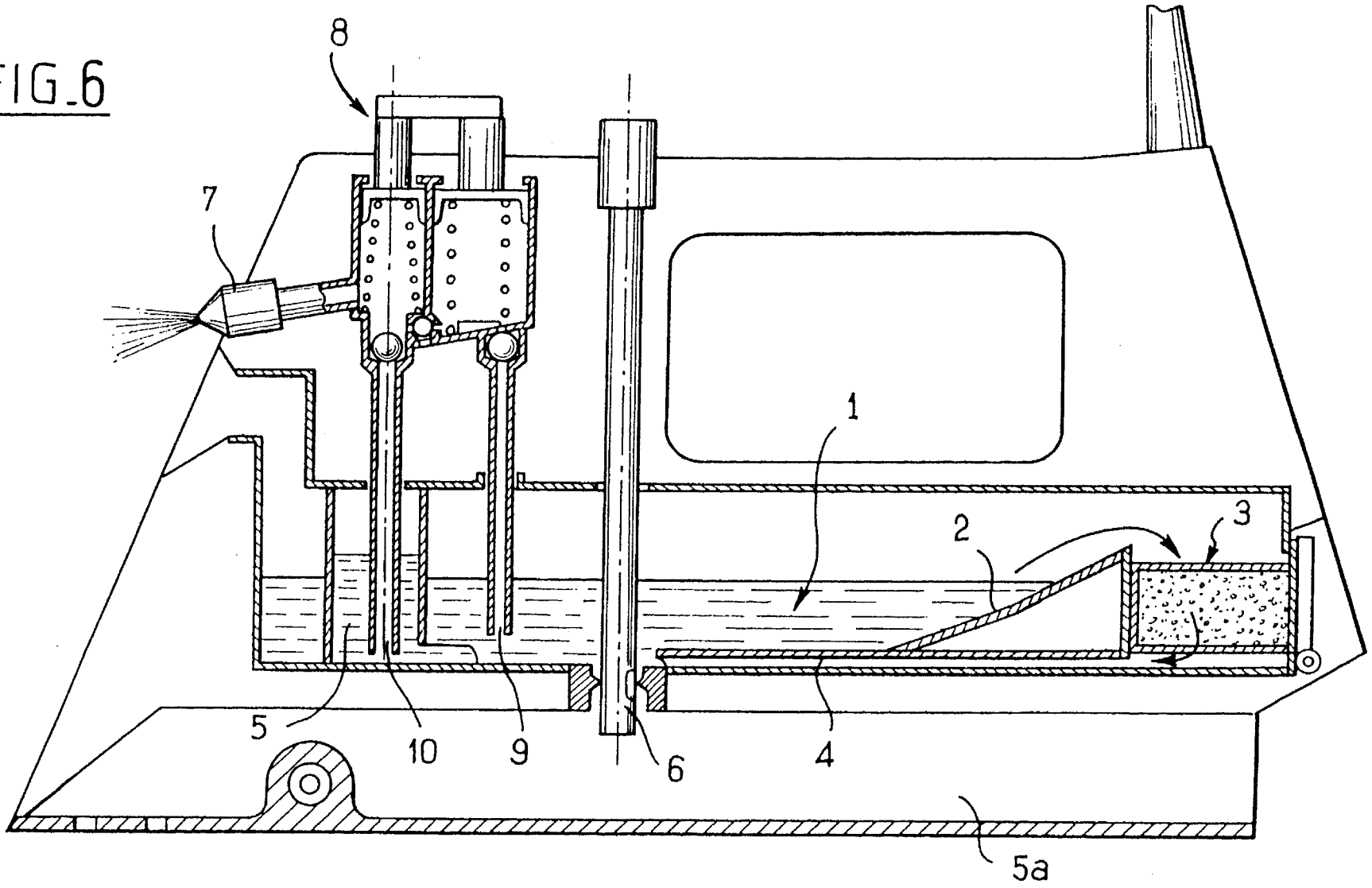

DESCRIPTION OF THE DEVICE ILLUSTRATED IN FIGS. 4 to 6

A main reservoir 1 is filled with water by the user. As a result of the movements of the iron, the water is caused to flow upwards on a ramp 2, then onto the top wall of a cartridge 3 containing a product for treatment of the water or of the cloth.

The treated or charged water flows through a duct 4 towards an auxiliary buffer reservoir 5.

A distributor 6 (plug valve) which controls the flow of water towards the vaporization chamber 5*a* is supplied preferably from the reservoir 1 (as shown in FIG. 4) or from the reservoir 5 (as shown in FIG. 5).

The pump 8 of the spray-nozzle 7 draws water from the buffer reservoir 5.

The iron can be provided with two differently calibrated plug valves, one of which is supplied from the reservoir 5 whilst the other is supplied from the reservoir 1.

The iron has a spray-nozzle 7 with a pump 8 having two inlets and two cylinder capacities. One inlet 10 having a low inflow rate draws water from the reservoir 5. The other inlet 9 having a higher inflow rate draws water from the reservoir 1 (as shown in FIG. 6).

The cartridge 3 can have two compartments hydraulically in series. Preferably the first (upstream) compartment contains a demineralizing substance whilst the other contains a cloth treatment product.

It is readily apparent that the hand pump 8 can be replaced by an electric pump.

Figure 7:
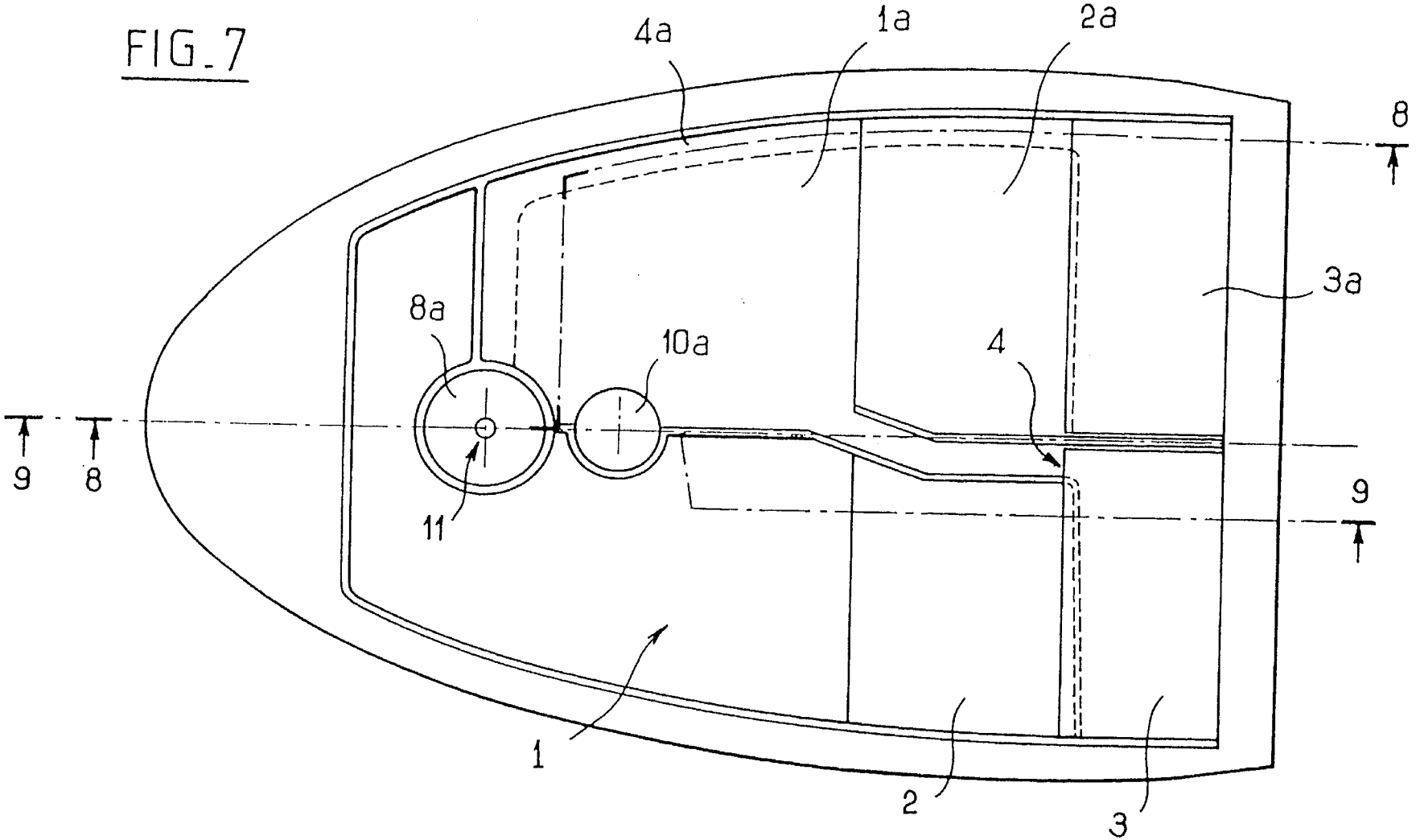
FIG. 7 is a schematic view taken in cross-section along a horizontal plane and showing an iron in accordance with another embodiment of the invention.
Figure 8:
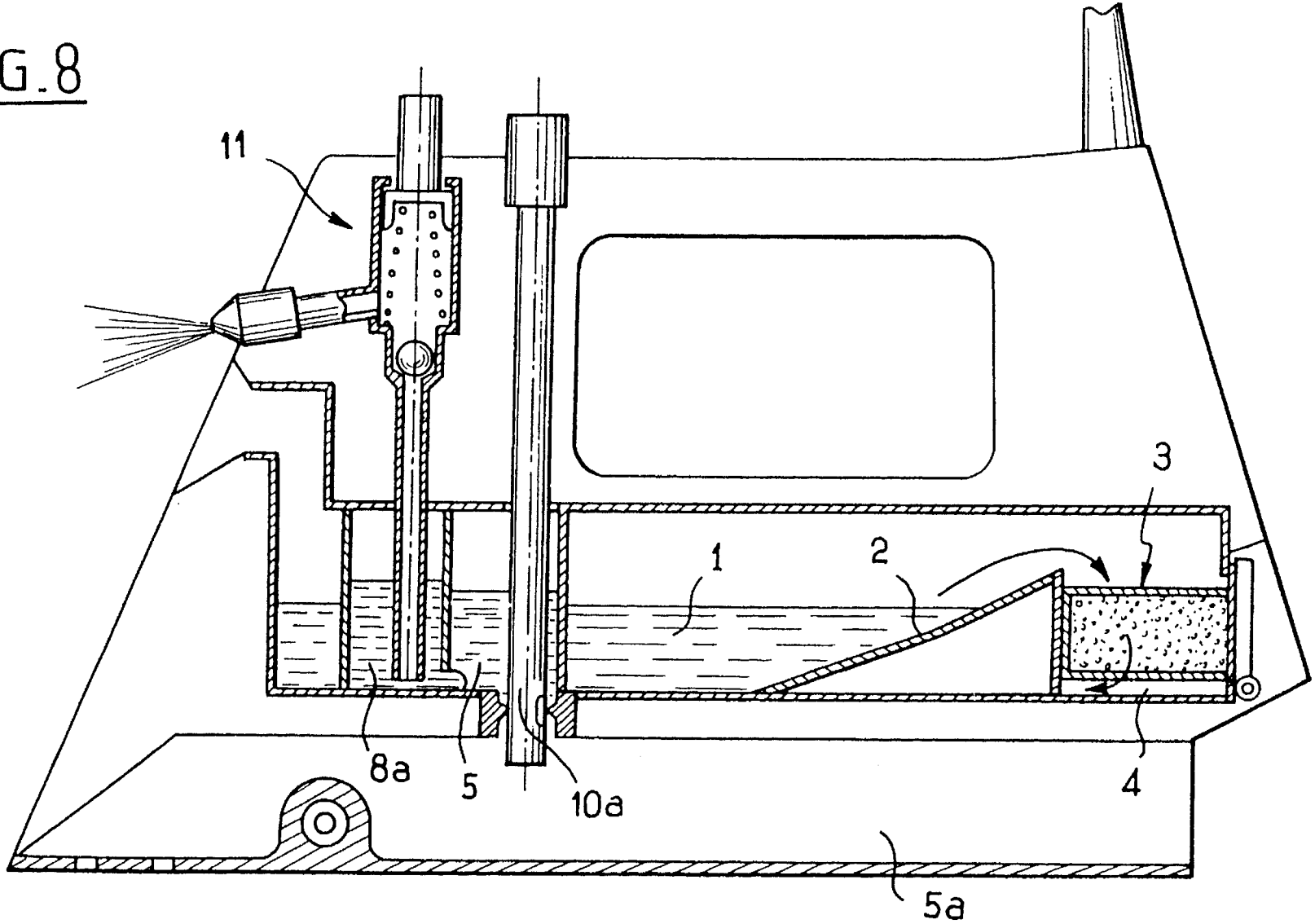
FIG. 8 is a longitudinal sectional view taken along line 8—8 of FIG. 7.
Figure 9:
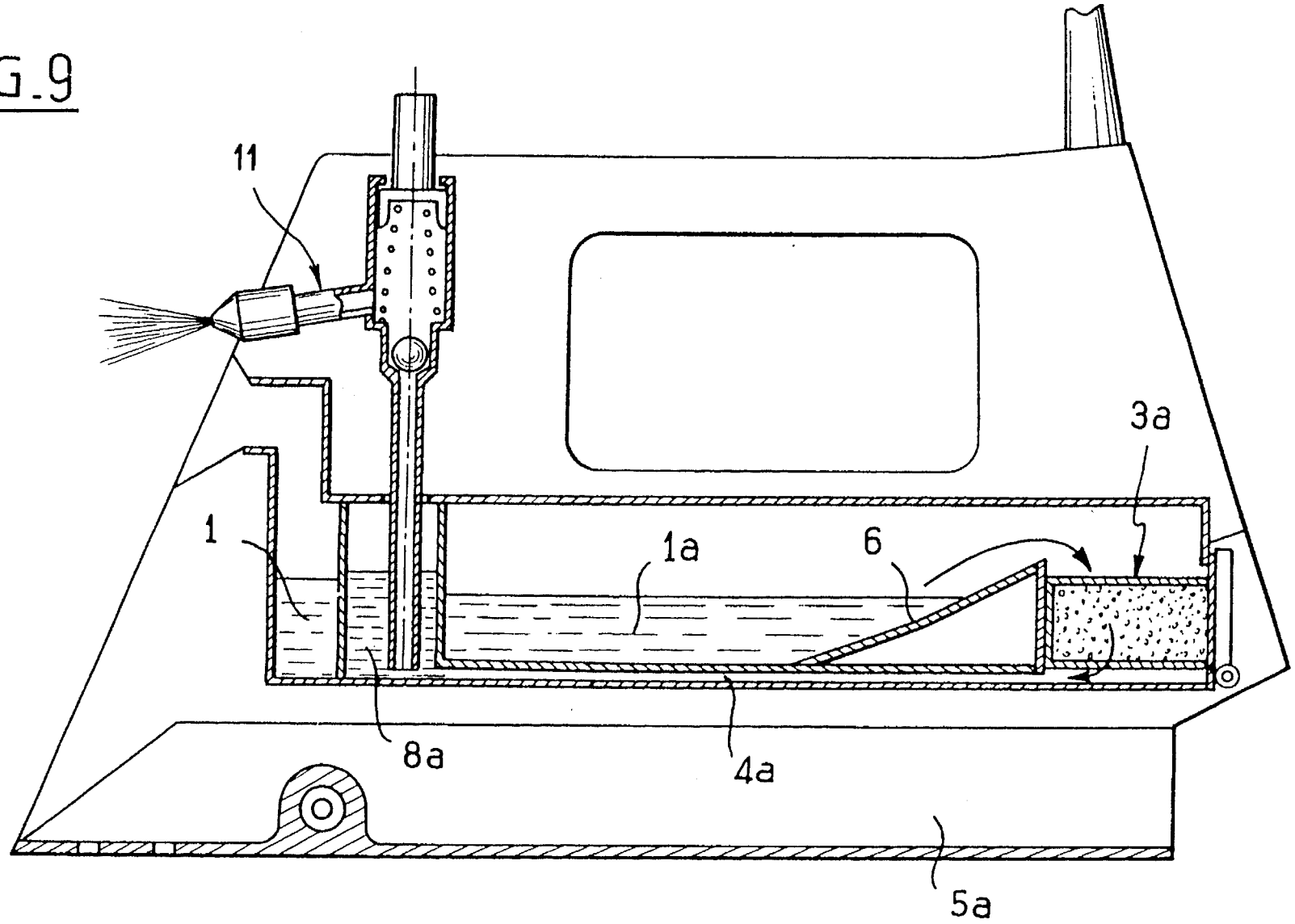
FIG. 9 is a longitudinal sectional view taken along line 9—9 of FIG. 7.

DESCRIPTION OF THE DEVICE ILLUSTRATED IN FIGS. 7 to 9

As a result of the movements of the iron, the water is caused to flow upwards from a reservoir 2 (shown in FIGS. 7 and 8) onto the top face of a first cartridge 3 through which it passes, then flows from the cartridge via an outlet 4 to a second reservoir 1*a*.

From the reservoir 1*a*, the water flows up a ramp 2*a* (FIGS. 7 and 9) onto the top face of a cartridge 3*a* through which it passes, then flows through a duct 4*a* to a buffer reservoir 8*a*.

In order to avoid flow problems, air vents are provided above the reservoirs 1*a* and 8*a*.

The standard plug valve 10*a* usually provided in irons can be supplied from any reservoir, preferably the reservoir 1*a* when the cartridge 3 is a demineralization cartridge and the cartridge 3*a* is a cartridge containing a treatment product.

Preferably, the spray-nozzle 11 is supplied from the buffer reservoir 8*a*.

In a more sophisticated design, the spray-nozzle has a double pump with two admission orifices.

An admission orifice draws water preferably from the buffer reservoir 8*a*. This orifice corresponds to a small-capacity inlet of the spray-nozzle pump.

The other orifice of the double pump draws water preferably from the reservoir 1*a* and corresponds to a larger-capacity inlet of the double pump.

This arrangement makes it possible to increase the period of autonomy of the cartridge 3*a* by highly diluting the final solution. Furthermore, when the buffer reservoir 8*a* is full, it prevents the circulation of water within the cartridge 3*a* which is not subject to wear if ironing is performed without using the treatment product.

In a preferential embodiment, the cartridge 3*a* contains a treatment product which is solid at the outset and dissolves while saturating the water which passes through. In this manner, a solution which is saturated with product arrives at the buffer reservoir 8*a*.

It is readily apparent that the pump described can be either a hand pump or an electric pump.

In another embodiment, the iron has two steam controls which may or may not be actuated simultaneously. These controls can consist of two plug valves which are preferably calibrated differently, one for a low rate of flow from the buffer reservoir 8*a*, the other for a higher rate of flow from the second reservoir 1*a*.

In the preferential embodiment, the cartridges 3 and 3*a* are separate and distinct from each other but it will be understood that they can be considered as a single cartridge having two main compartments.

Figure 10:
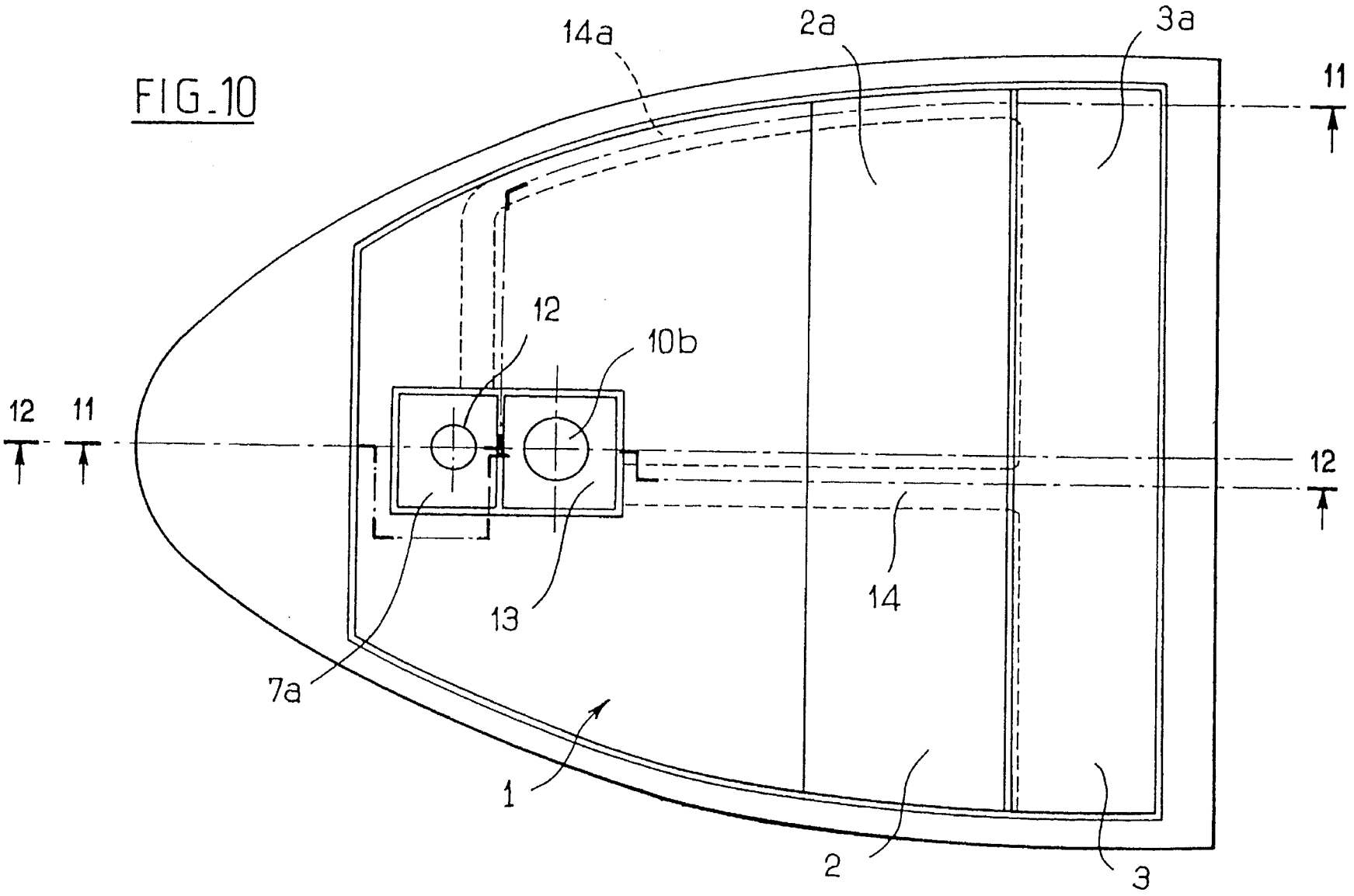
FIG. 10 is another schematic view in cross-section taken along a horizontal plane and showing an iron in accordance with another embodiment of the invention.
Figure 11:
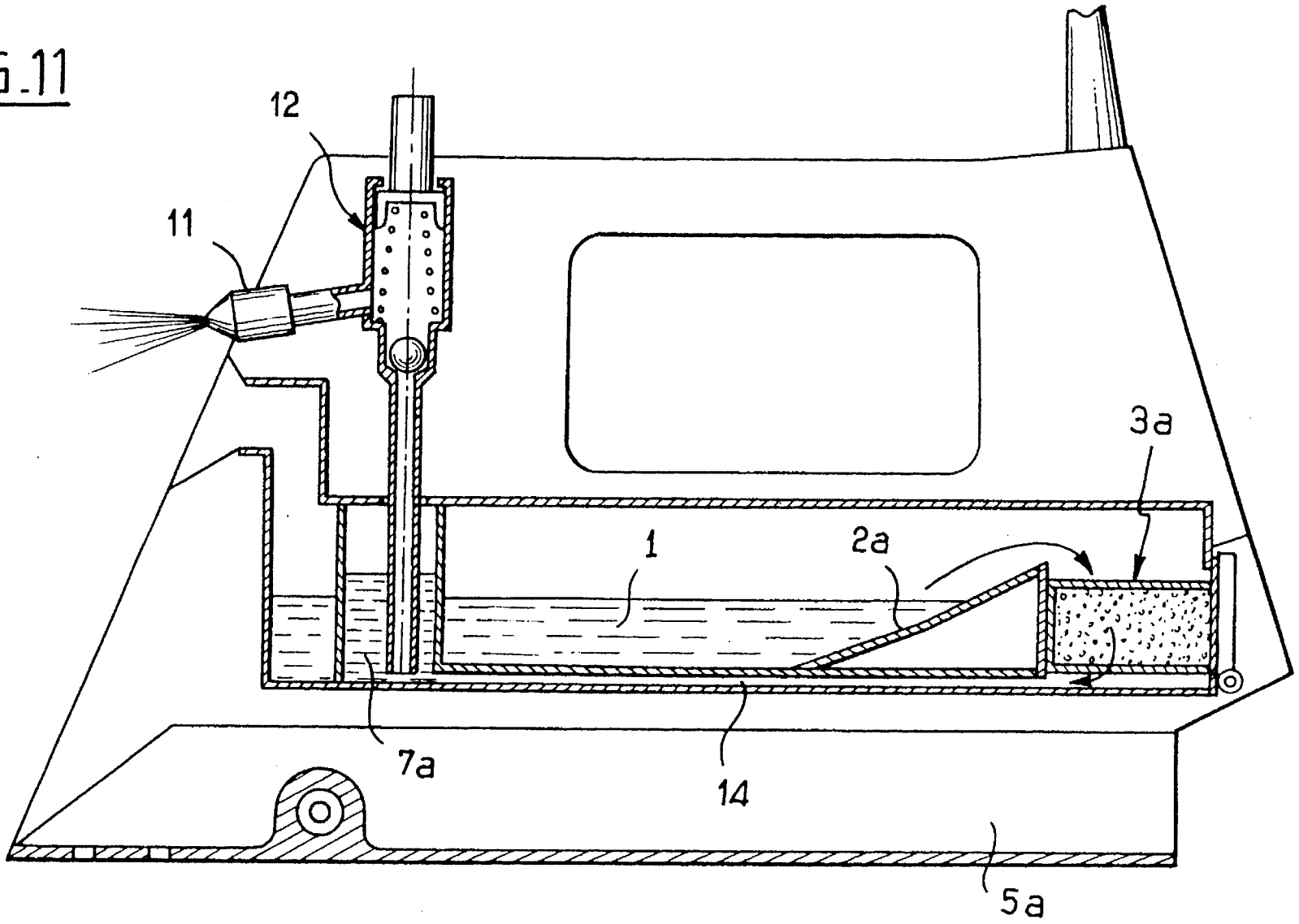
FIG. 11 is a longitudinal sectional view taken along line 11—11 of FIG. 10.
Figure 12:
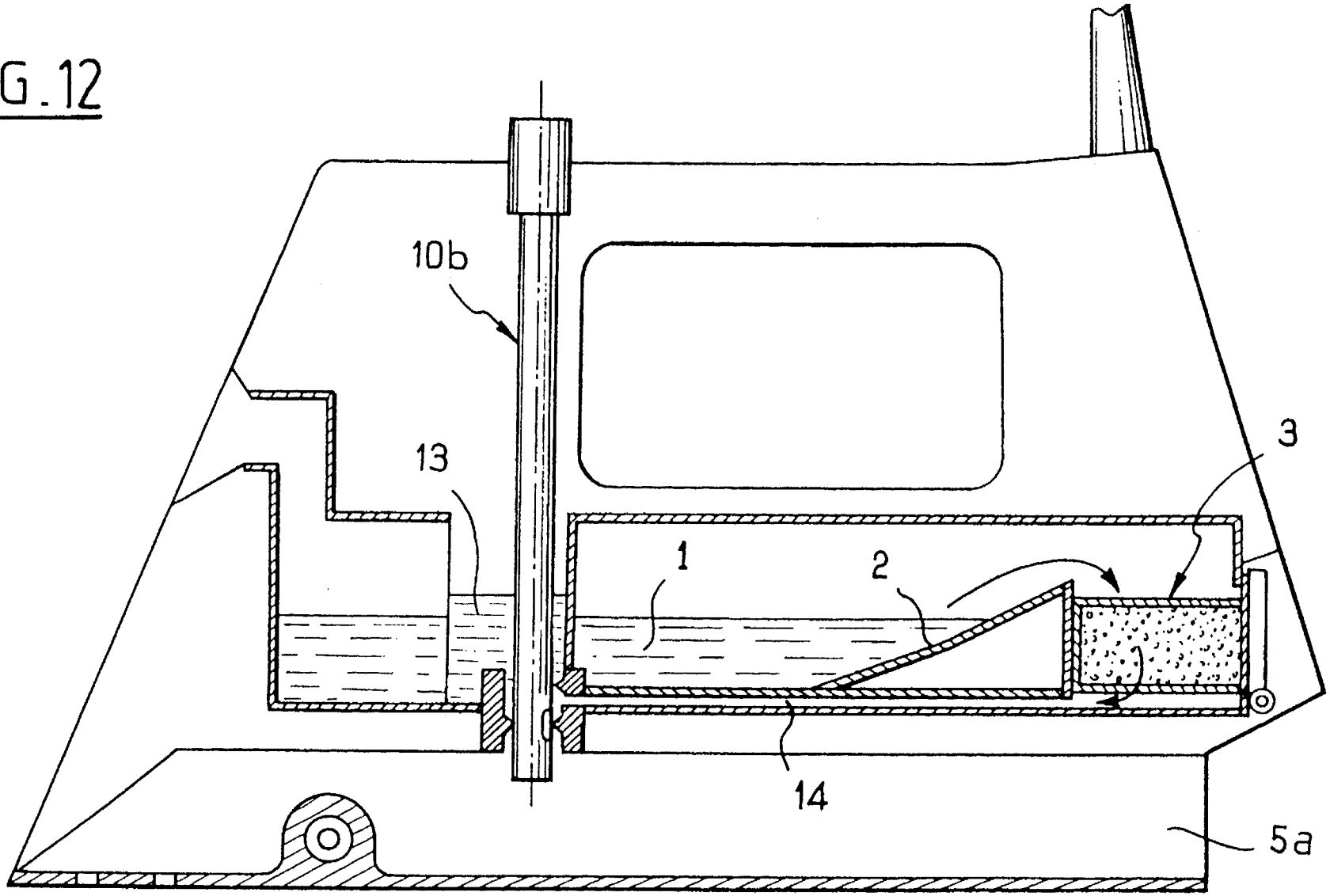
FIG. 12 is a longitudinal sectional view taken along line 12—12 of FIG. 10.

DESCRIPTION OF THE DEVICE ILLUSTRATED IN FIGS. 10 to 12

A main reservoir 1 is filled with water by the user.

As a result of the movements of the iron, the water flows up two similar ramps 2 and 2*a* onto the top face of two cartridges 3 and 3*a*, then flows through said cartridges towards two buffer reservoirs 13 and 7*a* respectively via ducts 14 and 14*a*.

Preferably, a cartridge such as the cartridge 3*a*, for example, is a cartridge containing a treatment product and the cartridge 3 is a cartridge for demineralization of the water.

The iron has at least one distributor system 10*b* (plug valve) for feeding the water to the vaporization chamber 5*a*. Preferably, the plug valve is supplied from the reservoir 13.

The iron has at least one spray discharge system 11 with a pump 12 which preferably draws water from the reservoir 7*a*.

This accordingly makes it possible to spare the demineralization cartridge 3 when making use of the spray discharge system which does not call for the use of demineralized water.

The pump 12 can be a pump having two inlets and two cylindrical chambers. The cylindrical chamber which has the smaller capacity draws water from the reservoir 7*a* whilst the other cylindrical chamber draws water from the reservoir 1, thus ensuring dilution.

The two cartridges can be grouped together in a single body having two main compartments. Each cartridge contains one or a number of treatment products (natural or synthesis) which exhibit at least one of the properties mentioned in the introductory part of this specification.

Preferably, the treatment product is introduced into the cartridge in solid form and is capable of dissolving with a product having a solubility K1.

There can be introduced with the noble material mentioned above a less noble material which is soluble with a product having a solubility K2 and which shares at least one common ion with the first, thus reducing the rate of solubilization of the noble substance.

DESCRIPTION OF THE DEVICE ILLUSTRATED IN FIGS. 13 to 16

Figure 13:
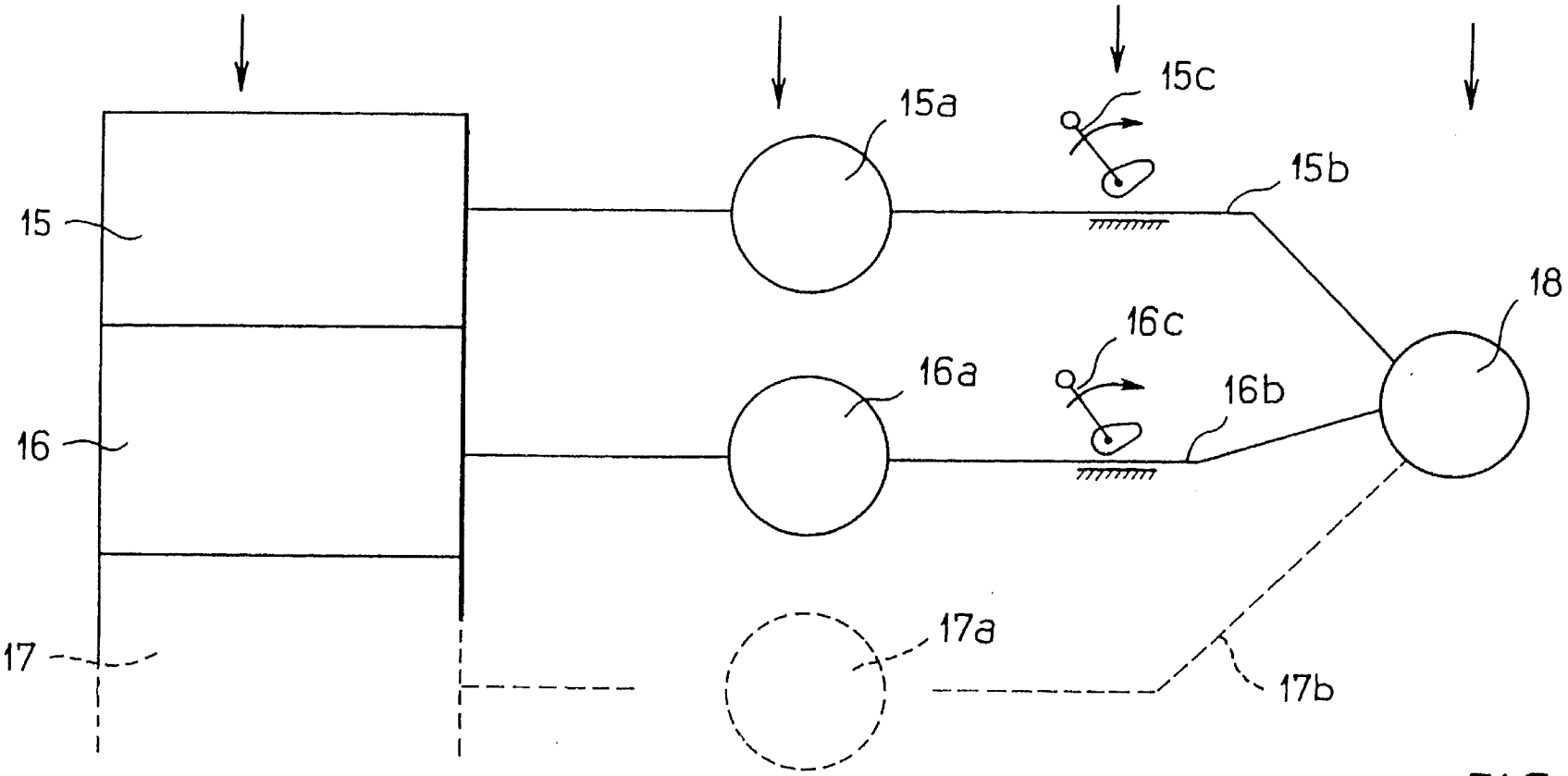
FIG. 13 is a schematic view showing the supply of water to a plurality of treatment cartridges from a plurality of buffer reservoirs.

At least one of the utilization points (spray discharge system or plug valve) is supplied from an additional buffer reservoir which (as shown in FIG. 13) receives water of different quality from at least one of the buffer reservoirs described earlier by means of ducts which can be closed.

The cartridges 15, 16, 17 supply separately buffer reservoirs 15*a*, 16*a*, 17*a* which are each connected to a main buffer reservoir 18 by means of flexible pipes 15*b*, 16*b*, 17*b*. Each flexible pipe is associated with a flow-control device 15*c*, 16*c* . . . which produces a pinching action on the corresponding flexible pipe.

The cartridge 20 is a container for products which are useful for the ironing operation.

Cartridges containing a single product (demineralizing resin) are already known. However, should it be desired to have several actions produced by the same cartridge, the device described below can be used.

Figure 14:
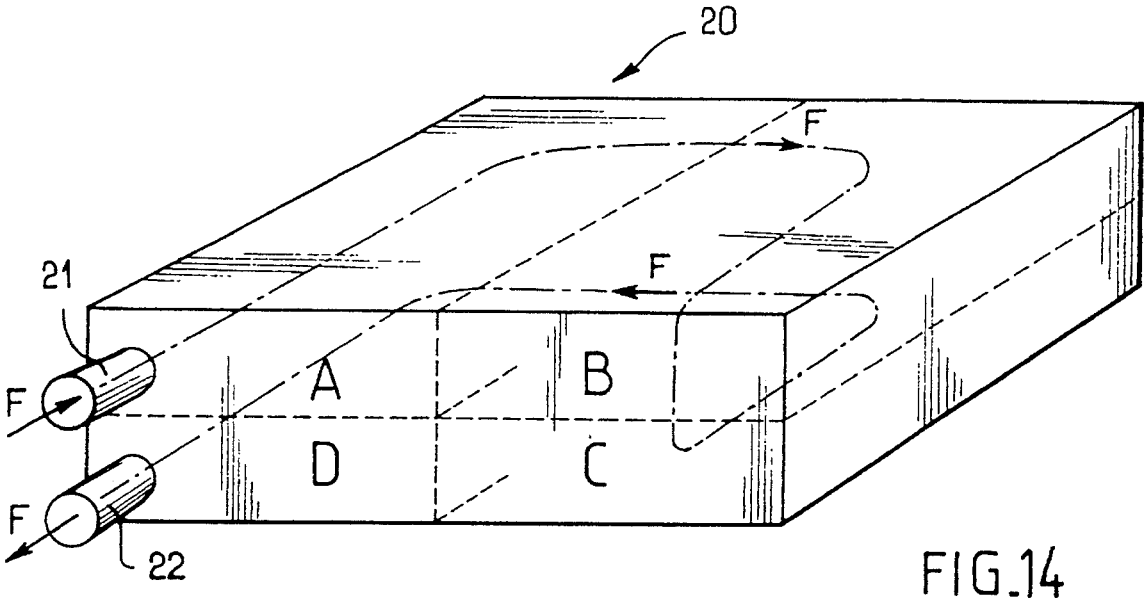
FIG. 14 is a view in perspective showing a cartridge having a plurality of compartments containing different treatment products.

Preferably, the cartridge 20 is parallelepipedal (as shown in FIG. 14) and has a number of main compartments A, B, C, D.

By way of example:

the first compartment A contains a demineralizing resin;

the second compartment B contains a slowly soluble product similar to starch;

the third compartment C contains a textile blueing salt;

a fourth compartment D contains a metal salt which makes the cloth hydrophilic.

The products can be free within each compartment or associated with a carrier for controlling the diffusion of said products.

The relative arrangement of the compartments A, B, C or D with respect to each other can be as desired. It is preferable, however, to adopt the arrangement of FIG. 14 in which the water inlet 21 is located at an upper compartment A. The water then passes into the adjacent compartment B, then to the lower portion before passing out at 22 through the last compartment D along the general path indicated by the arrows F (A→B→C→D) in order to have the advantage of the action of gravity at all times.

Each compartment is clearly designed to avoid excessive pressure drops within the product. To this end, known arrangements can be adopted for promoting efficient flow of water.

In another preferential embodiment of the invention, one or a number of compartments contain products which are mixed together and have complementary actions on the cloth and/or the water.

Different products are also mixed together when one of the components controls the diffusion of the active component or components.

Figure 15:
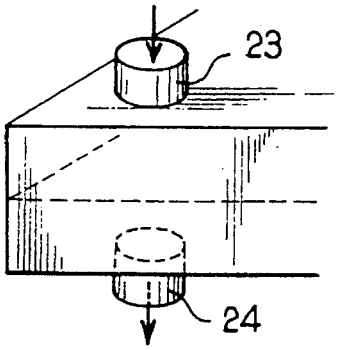
FIG. 15 is a partial schematic view showing another embodiment of a cartridge having a plurality of compartments.

The arrangement of the water inlet 23 and water outlet 24 can also be that shown in FIG. 15.

Figure 16:
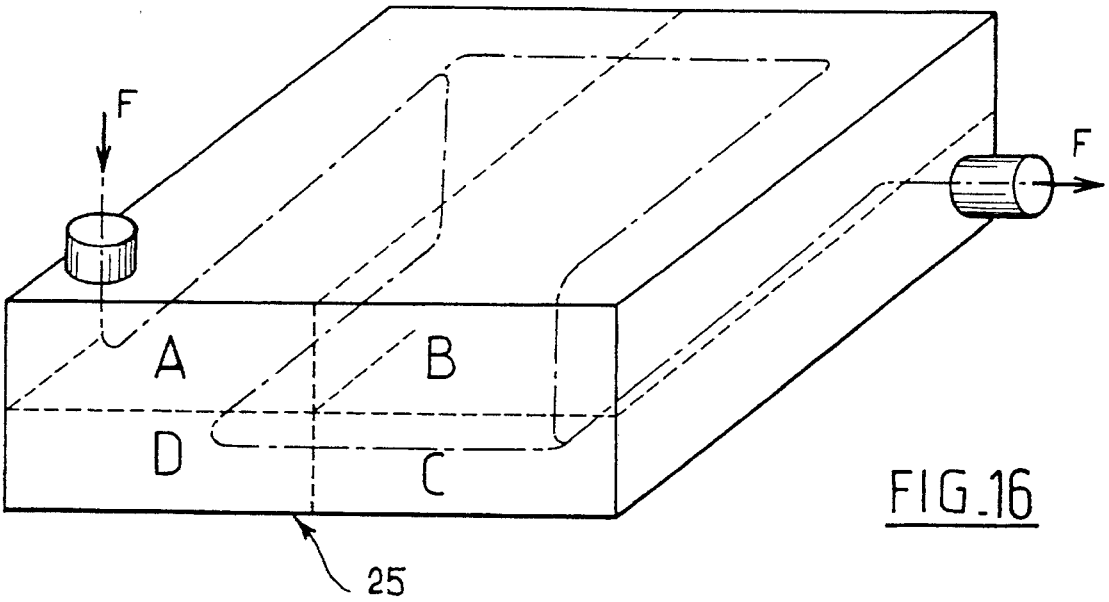
FIG. 16 is a schematic view in perspective showing another embodiment of a cartridge having a plurality of compartments.

In another embodiment of the invention (as shown in FIG. 16), the flowpath of water within the cartridge 25 is subdivided according to requirements. For example, the water flows from compartment A to compartment B for a fraction of the flow, and towards compartment D for the remainder. The flow percentages are controlled by the cross-sectional areas provided for the flow from one compartment to the other. This makes it possible in this example to diffuse less products contained in B and D. The streams then meet again in order to flow through C and to pass out. This example does not of course imply any limitation.

Provision can also be made for inlets in different compartments with one or a number of outlets. The water circuits may or may not be independent.

In all the embodiments described, the cartridge or the cartridges are removably placed within housings formed in the casing of the iron.

Means could also be provided for ensuring that, each time a control knob is actuated, a predetermined dose of product contained in one of the cartridges is released into the water circuit of the iron or directly into the vaporization chamber.

The cartridge filled with treatment product could be placed upstream of the water reservoir with respect to the direction of flow of the water in the iron in order to supply the water with treatment product continuously and in successive doses controlled by the user.

The cartridge could also be put in contact with the water contained in the reservoir in order to supply the water as indicated above.

In some cases, one or a number of inspection windows can be provided for examining the cartridges and observing the state of the product contained therein in order to decide according to this state whether or not it proves necessary to replace the cartridge or cartridges.

As will be readily apparent, the invention also applies to an iron having a water reservoir placed at a distance from the iron proper and connected thereto by a flexible hose.

What is claimed is:

1. A steam iron for ironing articles of clothing having a reservoir for supplying water to a vaporization chamber, comprising:

a housing;

a plurality of cartridges disposed within the housing, each of the plurality of cartridges containing at least one product for treating the water supplied to the vaporization chamber wherein the plurality of cartridges is arranged in parallel along a path in which the water flows as it travels from the reservoir to the vaporization chamber;

means for bringing the water in the reservoir into contact with the at least one product contained within each of the plurality of cartridges;

means for conveying the treated water from the plurality of cartridges to the vaporization chamber; and means for distributing the treated water over the articles to be ironed, the distribution means being in communication with the vaporization chamber.

2. A steam iron for ironing articles of clothing having a reservoir for supplying water to a vaporization chamber, comprising:

a housing;

at least one cartridge disposed within the housing, the at least one cartridge having a plurality of compartments, each compartment containing at least one product for treating the water supplied to the vaporization chamber wherein the plurality of compartments of the at least one cartridge is arranged in parallel along a path in which the water flows as it travels from the reservoir to the vaporization chamber;

means for bringing the water in the reservoir into contact with the at least one product contained within each compartment of the at least one cartridge;

means for conveying the treated water from the at least one cartridge to the vaporization chamber; and means for distributing the treated water over the articles to be ironed, the distribution means being in communication with the vaporization chamber.

3. A steam iron according to claims 1 or 2, wherein the means for bringing the water in the reservoir into contact with the at least one product contained within the at least one cartridge includes a ramp.

4. A steam iron according to claims 1 or 2, wherein the means for conveying the treated water from the at least one cartridge to the vaporization chamber includes a duct.

5. A steam iron according to claims 1 or 2, wherein the distribution means includes a plurality of steam discharge orifices.

6. A steam iron according to claims 1 or 2, further comprising a spray discharge system including an outlet for discharging the treated water from the iron in spray form towards the articles to be ironed, the outlet being disposed at a location remote from the distribution means.

7. A steam iron according to claim 6, wherein the spray discharge system is actuated by a hand pump.

8. A steam iron according to claim 6, wherein the spray discharge system is actuated by an electric pump.

9. A steam iron according to claims 1 or 2, wherein the at least one product is capable of diffusing in water.

10. A steam iron according to claims 1 or 2, wherein the at least one product is selected from the group consisting of: a starch, a deodorizer, a waterproofer, a disinfectant, an aseptic, a composition which produces firmness of pleats, a composition which improves the removal of creases, a composition which makes a cloth material hydrophilic, a composition which makes a cloth material hydrophobic, a composition which improves the wetting power of water, a composition which facilitates vaporization, an optical adjuvant, and a demineralizer.

11. A steam iron according to claims 1 or 2, wherein the at least one cartridge is removably placed within the housing.

12. A steam iron according to claims 1 or 2, further comprising means for controlling the rate of flow of water within the at least one cartridge.

13. A steam iron according to claims 1 or 2, wherein the at least one cartridge contains a mixture of products.

14. A steam iron according to claims 1 or 2, further comprising means for introducing a predetermined dose of the at least one product into the reservoir of the iron.

15. A steam iron according to claims 1 or 2, wherein the at least one cartridge is refillable.

16. A steam iron according to claims 1 or 2, wherein the at least one cartridge is disposable.

17. A steam iron according to claims 1 or 2, further comprising means for observing from outside the housing a level of the at least one product contained within the at least one cartridge.

18. A steam iron according to claim 1 or 2 wherein the at least one cartridge is in permanent fluid communication with the reservoir.

19. A steam iron having a reservoir for supplying water to a vaporization chamber, comprising a plurality of cartridges wherein the plurality of cartridges are placed in parallel with respect to a path of flow of the water from the reservoir, each cartridge containing a different product for treating the water, and means for bringing the water of the reservoir into contact with the treatment products and for distributing the resulting water over an article to be ironed.

20. A steam iron according to claim 19 wherein the product for treating the water is associated with a water insoluble carrier which controls the solubility of the product.

21. A steam iron for ironing articles of clothing having a reservoir for supplying water to a vaporization chamber, comprising:

a housing;

a plurality of cartridges disposed within the housing, each of the plurality of cartridges containing at least one product for treating the water supplied to the vaporization chamber wherein the plurality of cartridges is arranged in series and in parallel along a path in which the water flows as it travels from the reservoir to the vaporization chamber;

means for bringing the water in the reservoir into contact with the at least one product contained within each of the plurality of cartridges;

means for conveying the treated water from the plurality of cartridges to the vaporization chamber; and means for distributing the treated water over the articles to be ironed, the distribution means being in communication with the vaporization chamber.

22. A steam iron for ironing articles of clothing having a reservoir for supplying water to a vaporization chamber, comprising:

a housing;

at least one cartridge disposed within the housing, the at least one cartridge having a plurality of compartments, each compartment containing at least one product for treating the water supplied to the vaporization chamber wherein the plurality of compartments of the at least one cartridge is arranged in series and in parallel along a path in which the water flows as it travels from the reservoir to the vaporization chamber;

means for bringing the water in the reservoir into contact with the at least one product contained within each compartment of the at least one cartridge;

means for conveying the treated water from the at least one cartridge to the vaporization chamber; and means for distributing the treated water over the articles to be ironed, the distribution means being in communication with the vaporization chamber.

23. A steam iron having a reservoir for supplying water to a vaporization chamber, comprising a plurality of cartridges wherein the plurality of cartridges are arranged in a circuit in series and in parallel with respect to a path of flow of the water from the reservoir, each cartridge containing a different product for treating the water, and means for bringing the water of the reservoir into contact with the treatment products and for distributing the resulting water over an article to be ironed.

* * * * *